US009089896B2

(12) United States Patent
Goller et al.

(10) Patent No.: US 9,089,896 B2
(45) Date of Patent: Jul. 28, 2015

(54) DEVICE AND METHOD FOR HOT ISOSTATIC PRESSING

(75) Inventors: George Albert Goller, Greenville, SC (US); Paul Stephen Dimascio, Greer, SC (US); Raymond Joseph Stonitsch, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 533 days.

(21) Appl. No.: 12/511,354

(22) Filed: Jul. 29, 2009

(65) Prior Publication Data

US 2011/0027120 A1 Feb. 3, 2011

(51) Int. Cl.
*B22F 3/15* (2006.01)
*B22F 3/12* (2006.01)

(52) U.S. Cl.
CPC ..... *B22F 3/15* (2013.01); *B22F 3/1208* (2013.01)

(58) Field of Classification Search
CPC ..... B22F 3/15; B22F 3/1208
USPC ..... 425/78; 419/49
IPC ..... B65D 88/128
See application file for complete search history.

(56) References Cited

U.S. PATENT DOCUMENTS

| | | | | |
|---|---|---|---|---|
| 3,460,718 | A * | 8/1969 | Plant | 222/143 |
| 4,582,681 | A | 4/1986 | Asari et al. | |
| 4,602,952 | A | 7/1986 | Greene et al. | |
| 4,938,673 | A | 7/1990 | Adrian | |
| 7,118,809 | B2 | 10/2006 | Utyashev et al. | |

FOREIGN PATENT DOCUMENTS

| | | | |
|---|---|---|---|
| EP | 44381 | A1 * | 1/1982 |

* cited by examiner

*Primary Examiner* — Weiping Zhu
(74) *Attorney, Agent, or Firm* — Dority & Manning, P.A.

(57) ABSTRACT

Improved methods and containers for forming billets using hot isostatic pressing are provided. The methods and containers have features that control the deformations of the container during the high temperatures and pressures experienced in such processing so that the loss or removal of material from the resulting billet can be optimized.

13 Claims, 3 Drawing Sheets

DEVICE AND METHOD FOR HOT ISOSTATIC PRESSING

FIELD OF THE INVENTION

The subject matter disclosed herein relates to an improved method and container for forming billets using hot isostatic pressing and, more specifically, to a method and container having features that control the deformations of the container during the high temperatures and pressures experienced in such processing.

BACKGROUND OF THE INVENTION

Metallurgical techniques have been developed for the manufacture of a metal billet or other object from metal powders created in a predetermined particle size by e.g., microcasting or atomization. Usually highly alloyed with Ni, Cr, Co, and Fe, these powders are consolidated into a dense mass approaching 100 percent theoretical density. The resulting billets have a uniform composition and dense microstructure providing for the manufacture of components having improved toughness, strength, fracture resistance, and thermal expansion coefficients. Such improved properties can be particularly valuable in the fabrication of e.g., rotary components for a turbine where high temperatures and/or high stress conditions exist.

The consolidation of these metal powders into a dense mass typically occurs under high pressures and temperatures in a process referred to as hot isostatic pressing (HIP). Typically, the powders are placed into a container (sometimes referred to as a "can") that has been sealed and its contents placed under a vacuum. The container is also subjected to an elevated temperature and pressurized on the outside using an inert gas such as e.g., argon to avoid chemical reaction. For example, temperatures as high as 480° C. to 1315° C. and pressures from 51 MPa to 310 MPa or even higher may be applied to process the metal powder. By pressurizing the container that is enclosing the powder, the selected fluid medium (e.g., an inert gas) applies pressure to the powder at all sides and in all directions.

The equipment required for HIP treatment is typically very costly and requires special construction. Due to the extreme temperatures and pressures, the container is substantially deformed or crushed as the volume of the powder decreases during the HIP process and the container becomes joined to the surface of the billet created by the compacted powder. Depending upon the desired shape for the resulting billet, all or portions of the surface of the container may be cut away i.e., by machining after the HIP process. In addition, portions of the billet may also be cut away depending upon the shape desired and the nature of deformations that occurred during the HIP process. Given that the powder used to manufacture the billet is typically very expensive, removal of portions of the billet is undesirable. A process that allows for shape control during compaction while optimizing the removal of material from the billet is needed.

FIGS. 1A and 1B provide an exemplary illustration of the problems confronted using conventional containers in the HIP process. FIG. 1A provides a schematic illustration of a portion of a container 101 before being subjected to the extreme temperature and pressure of the HIP process. Container 101 encloses the powder mixture 105 intended for compaction and provides a seal to prevent the ingress of the fluid used for pressurization e.g., argon during the HIP process. Before pressurization, the walls 110 between top 100 and bottom 135 are basically straight and/or without deformation. Top 100 and bottom 135 are also undeformed before the HIP process.

In general, the thickness, type, and structure of material used for container 101 is determined in part by the weight of powder to be held within container 101. More particularly, in addition to providing a pressure seal, container 101 is also used to transport the powder to a pressure vessel for the HIP process and, therefore, must be constructed to bear the weight of the powder e.g., several tons in some applications. For example, container 101 might be constructed from mild steel of approximately ½" in thickness. However, other materials and thicknesses may be used. If the container is intended to remain on the billet for inclusion on the ultimate article of manufacture, additional considerations may determine the choice of material for container 101.

FIG. 1B illustrates the same portion of container 101 after being subject to the HIP process. The conditions of the HIP process have now converted the powder into a metal billet 106. However, the change in density from powder to a solid metal has also resulted in a rather dramatic change in volume. As the volume decreased, container 101 also deformed with the change from powder 105 to billet 106. FIG. 1B illustrates that wall 110 has now taken on an arcuate shape, and top 100 and bottom 135 may undergo deformations as well.

Unfortunately, depending upon the shape desired for billet 106 (or the shape of the ultimate component to be constructed from billet 106), the deformations shown in FIG. 1B may be undesirable because the resulting shape for billet 106 may require the removal of valuable material from its surface. For example, assuming a cylindrical outer surface is needed along wall 110 of billet 106, container 101 and billet 106 may need to be cut i.e., machined along line 130 in order to obtain the desired outer surface. However, in addition to the destruction of container 101, significant amounts of the billet 106 will be lost at portions 115 along the top and bottom of container 101. Because of the substantial costs of the original powder, this loss is undesirable. In addition, although less significant than the powder costs, portions of container 101 are also lost as a result of the machining process.

Therefore, an improved device that provides for the reduction or elimination of powder loss in connection with HIP treatment would be useful. An improved device that also allows for more variation in the construction of containers associated with HIP treatment would also be useful.

BRIEF DESCRIPTION OF THE INVENTION

Objects and advantages of the invention will be set forth in part in the following description, or may be obvious from the description, or may be learned through practice of the invention.

The present invention provides for an improved method and container for use in HIP processing. More specifically, the present invention provides a method and container having one or more features that control deformation of the container during HIP processing so that material loss can be eliminated or reduced. The present invention can also allow for additional efficiencies in that containers constructed from different materials and structures are also provided.

For example, in one exemplary embodiment, the present invention provides a container for use during hot isostatic pressing of a powder into a billet. The container includes at least one wall contacting the powder. A plurality of shape-control elements are positioned along such wall. The shape-control elements are configured for controlling the deformation of the container during the hot isostatic processing such that the resulting billet has at least one surface that is convex, concave, or both after the hot-isostatic processing.

In another exemplary embodiment, a container for compaction processing of a powder is provided. The container includes a cylindrically-shaped outer wall that defines axial and circumferential directions. The outer wall has a plurality of shape-control elements spaced along the circumferential direction of the outer wall. The shape-control elements are configured for determining the deformation of the outer wall as the volume of the powder is reduced under pressure. A container top and a container bottom are connected to the outer wall. The outer wall extends between the container top and the container bottom so as to define an interior of the container for receipt of the powder.

In another exemplary aspect of the present invention, a method for optimizing the use of material during hot isostatic pressing is provided. The method includes the steps of providing a container for the receipt of a powder intended for compaction, determining the position of shape-control elements along at least one wall of the container, the shape-control elements configured for controlling the deformation of the container during hot isostatic pressing; positioning the shape-control elements along at least one wall of the container; and deforming the container while compacting the powder during hot isostatic pressing so as to provide a billet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of exemplary embodiments of the present invention, directed to one of ordinary skill in the art, is set forth in the specification, which makes reference to the appended figures, in which.

DETAILED DESCRIPTION

Figure 1A:
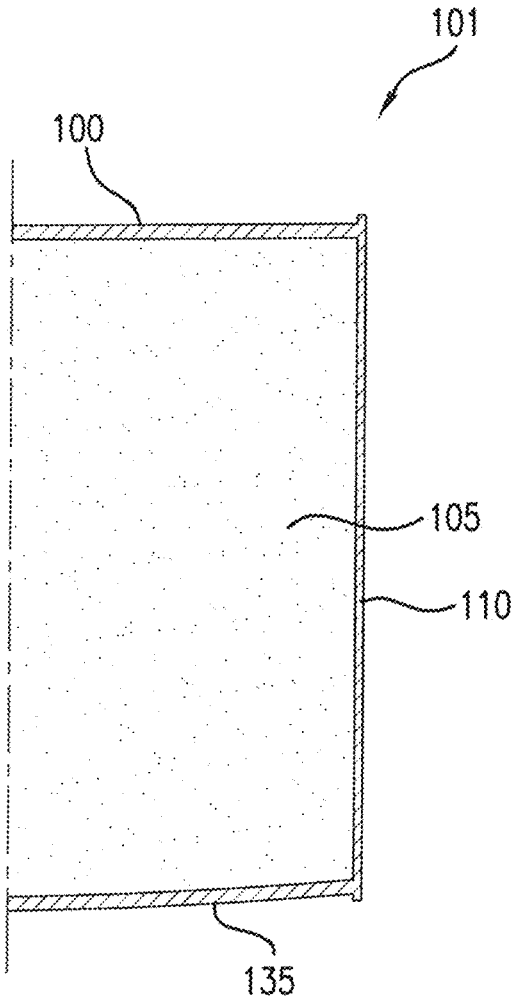
FIG. 1A is a schematic cross-section along one side of a container before subjection to a HIP process.

For purposes of describing the invention, reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used with another embodiment to yield a still further embodiment. Thus, it is intended that the present invention covers such modifications and variations as come within the scope of the appended claims and their equivalents.

Figure 2:
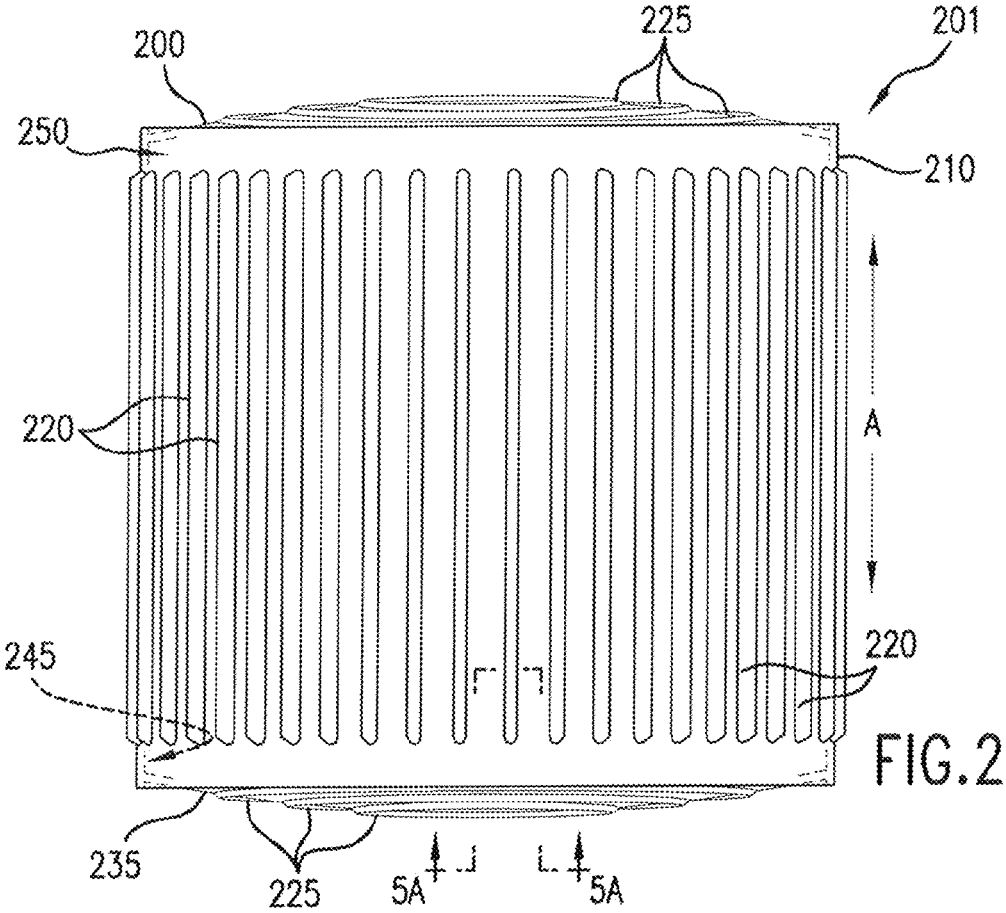
FIG. 2 is perspective view of an exemplary embodiment of a container according to the present invention.
Figure 3:
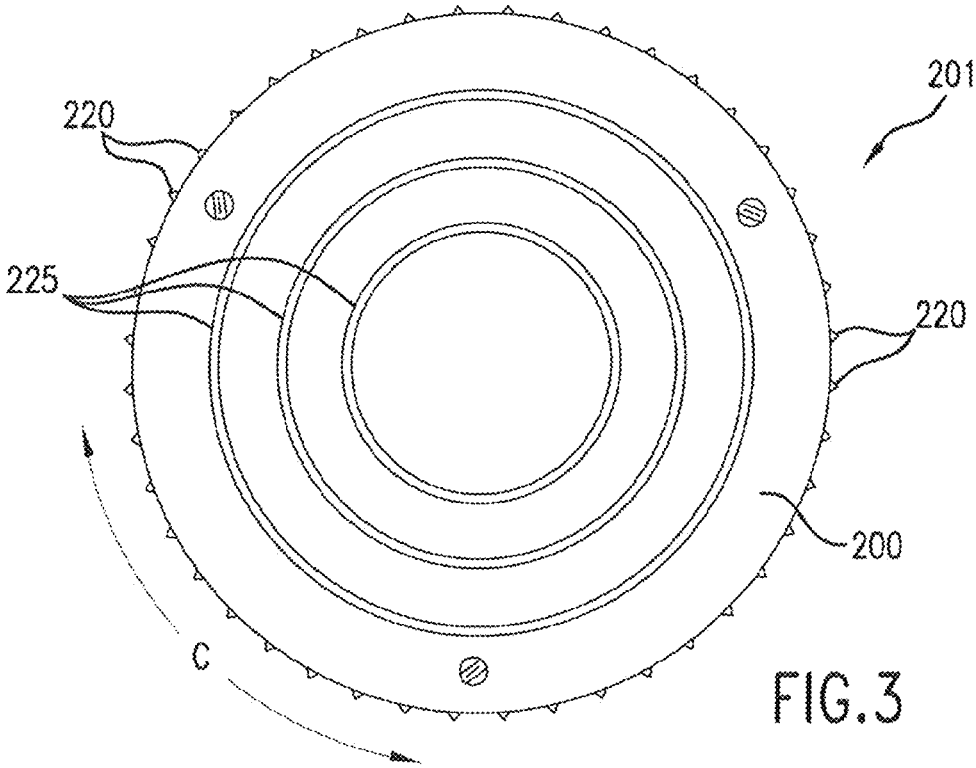
FIG. 3 is a top view of the exemplary embodiment of the container shown in FIG. 2.

FIGS. 2 and 3 provide an exemplary embodiment of a container 201 constructed according to the present invention. In particular, container 201 contains shape-control elements 220 positioned along the circumferential direction C (FIG. 3) of cylindrically-shaped wall 210 and along the outside surface 250 thereof. Each shape-control element 220 extends longitudinally along the axial direction A (FIG. 2) of wall 210. As best seen from FIG. 3 and FIG. 5A, each shape-control element 220 has a triangular cross-section.

Figure 1B:
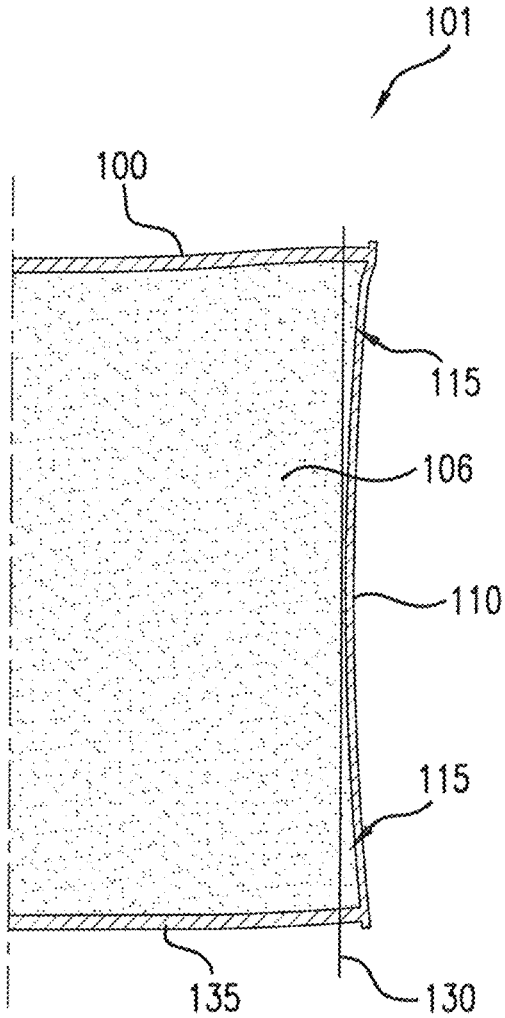
FIG. 1B is a schematic cross-section along one side of the container of FIG. 1A after undergoing the pressure and temperature of a HIP process.
Figure 4:
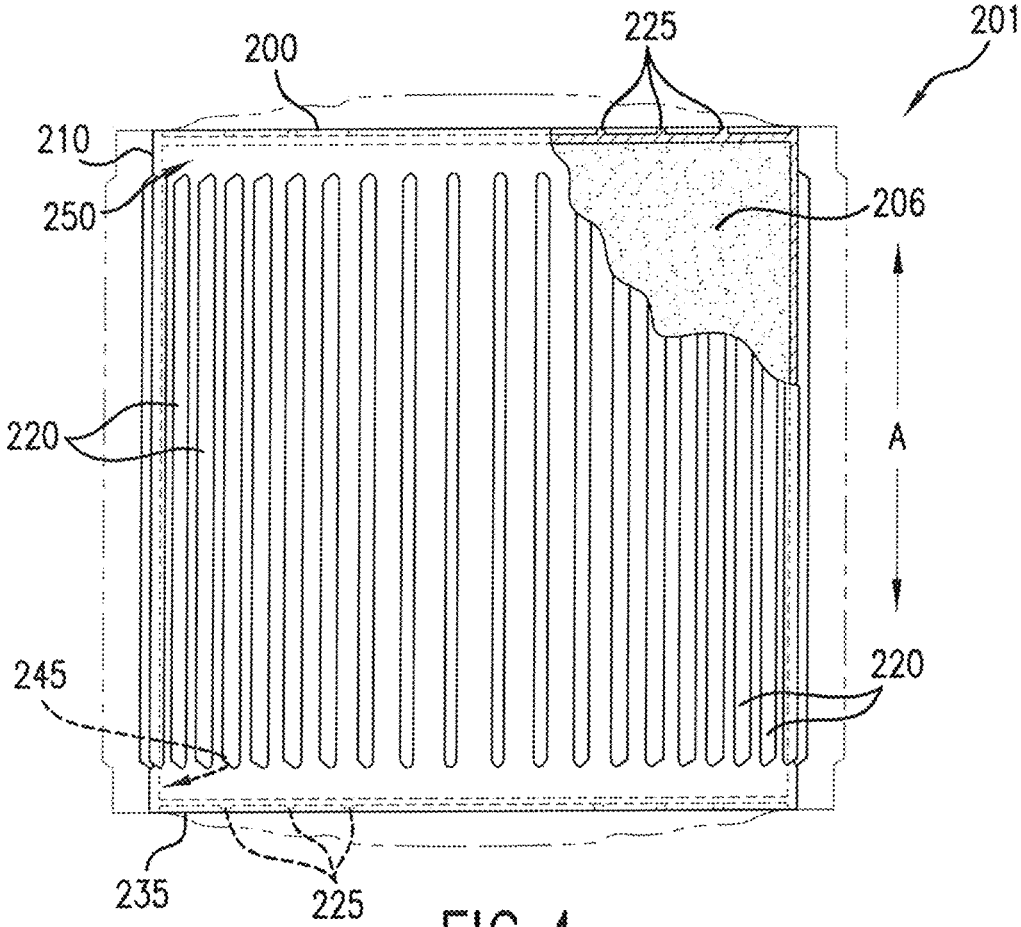
FIG. 4 is a side view of the exemplary embodiment of FIG. 2 after being subjected to a HIP process.

Shape-control elements 220 provide reinforcements to control the deformation of container 201 during the HIP process. More particularly, for the exemplary embodiment of container 201, shape-control elements 220 prevent or minimize arcuate deformation of wall 210 during the HIP process as occurred with wall 110 in FIG. 1B. FIG. 4 depicts container 201 after being subjected to the HIP process. The volume of container 201 has decreased as illustrated by phantom lines and the closer spacing of shape control elements 220. However, while wall 210 has experienced deformation, wall 210 remains substantially straight as part of a controlled deformation. Accordingly, the shape of billet 206 retains the desired cylindrical shape as shown in the cut-way portion of FIG. 4. As such, whether container 201 is to be left on billet 206 or removed by machining, the use of powder in creating billet 206 has been optimized with little or no loss of valuable material.

Features for shape control can be added to other surfaces of container 201 as well. For example, container top 200 and bottom 235 each have shape-control elements 225. These shape-control elements 225 are configured so that as the powder volume decreases by compaction to become billet 206, the deformation results in a flat surface. More specifically, as shown in FIG. 2, top 200 and bottom 235 each have a slightly arcuate shape. During the HIP process, shape-control elements 225 allow top 200 and bottom 235 to deform in a controlled manner such that the resulting shape provides a flat surface as shown in the cutaway portion of FIG. 4. It should be understood that the resulting cylindrically-shaped billet 206 is provided by way of example only. Other shapes for billet 206 may be desired and container 201 and its associated shape control elements can be modified accordingly.

Using the teachings disclosed herein, one of ordinary skill in the art will understand that multiple variations for the shape-control elements can be used to control the deformation to the container that occurs during the HIP process in order to achieve the shape desired for the resulting billet. Returning to the embodiment of FIG. 2, for example, the length and orientation of shape-control elements 220 along the axial direction A can be modified depending upon the deformation desired, the compaction behavior of the powder, the process conditions of the HIP, and other variables. By way of example, shape-control elements 220 could be oriented diagonally, horizontally, and at different spacings and thickness than shown in FIG. 2. Similarly, for top 200 as shown in FIG. 3, the spacing, shape, thickness, and orientation of shape control elements 225 can be varied to control deformation as desired.

Figure 5A:
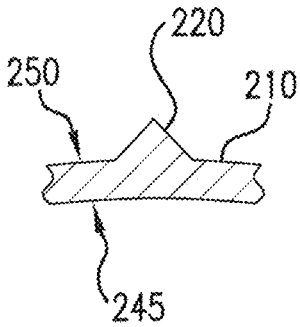

Additionally, the cross-section of the shape-control elements can also varied. As previously described, shape-control element 220 has a triangular cross-section as shown in FIG. 5A. However, many other shapes can be applied, and FIG. 5B provides an example of a hemispherical cross-section for shape-control element 260.

Figure 5B:
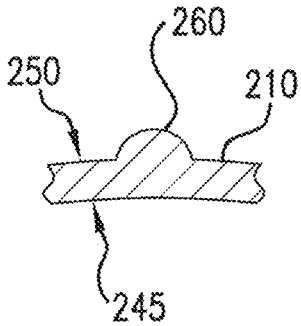
Figure 5C:
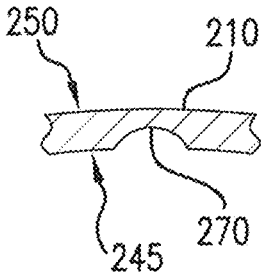

The shape-control elements of FIGS. 4, 5A, and 5B are depicted as being located along the outside surface 250 of the wall of container 201. Using the teachings disclosed herein, it should be understood that shape-control features can also be located along the inside surface 245 of container 201. For example, FIG. 5C depicts a shape-control element 270 have dimple-like cross-section located along the inside surface 245. This shape-control element 270 could be constructed as an indentation extending longitudinally in the axial direction A over some predetermined portion of the length of wall 210. Alternatively, shape-control element 270 could be constructed as a series of dimples (i.e., indentations) arranged in various orientations along wall 210 depending upon the resulting deformation that is desired. Rather than only reinforcing wall 210, the dimple shape-control elements 270 help control deformation by initiating the points at which buckling occurs as container 201 is compressed during the HIP process.

The shape-control elements in FIGS. 2, 3, 4, and 5A-5C are illustrated as being an integral part of wall 210. However, shape-control elements can also be welded or otherwise attached to the inner surface 245 or outer surface 250 of wall 210. For example, in lieu of the shape-control elements 220 on container 201, a serious of plates could welded to wall 210 at locations spaced about the circumferential direction C. As previously indicated, the width, length, and location of such plates are determined according to the deformation desired for container 201 during the HIP process.

In addition to providing for control of the deformation that occurs during compaction in the HIP process, the use of shape-control elements allows for container 201 to be constructed with thinner walls made from a variety of materials such as e.g., stronger, higher alloy materials that used for container 101. This results in part because shape-control elements are being used to control the deformation rather than relying upon the thickness of the container to determine the shape of the resulting billet. Also, by using shape-control elements to optimize the deformation of the powder and using a support frame or carriage device (not shown) to support the container, less material can be used in the construction of container as it is not being relied upon to support the weight of the powder or billet during transport.

Examples of the present invention have been described with reference to a cylindrically-shaped container 201 for which arcuate deformation of wall 210 was not desired. However, the present invention applies to other desired shapes for both the container and billet—before and after the HIP process. For example, it may be desirable to have concave surfaces, convex surfaces, or both in the resulting billet. As such, the shape of the container before the HIP process and the desired shape for the billet after the HIP process may be non-cylindrical depending upon the intended application for the resulting billet. Regardless, in each case, the present invention provides for the application of shape-control elements that are located and configured to control deformation during the HIP process in order to achieve a predetermined shape for the resulting billet. By way of example, before submitting to the HIP process, the container might have one or more concave walls to which shape-control elements have been added so that the concave shape is maintained or even further accentuated after the HIP process. Alternatively, the shape-control elements may be configured to provide deformation control of the container from e.g., one or more straight surfaces to one or more convex or concave surfaces after the HIP process. Accordingly, the present invention is not limited to any particular shapes for the container or resulting billet and, instead, provides apparatus and methods for controlling deformation during the HIP process so as to achieve a predetermined shape for the resulting billet. As a result, savings in both material costs and manufacturing time are achieved.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A container for compaction processing of a powder, the container comprising:

a cylindrically-shaped outer wall, said outer wall defining axial and circumferential directions, said outer wall being straight along the axial direction and having a plurality of shape-control elements spaced along the circumferential direction of said outer wall, said shape-control elements attached to the cylindrically-shaped outer wall and configured for determining the deformation of said outer wall as the volume of the powder is reduced under pressure to form a billet of a desired shape;

a container top connected to said outer wall; and a container bottom connected to said outer wall such that said outer wall extends between said container top and said container bottom so as to define an interior of the container for receipt of the powder.

2. A container for compaction processing of a powder as in claim 1, wherein said container comprises a metal, and wherein said shape-control elements comprise projections extending longitudinally along the axial direction of said outer wall.

3. A container for compaction processing of a powder as in claim 1, wherein said shape-control elements comprise projections extending longitudinally along the axial direction of said outer wall, wherein said projections have a triangular cross-section.

4. A container for compaction processing of a powder as in claim 1, wherein said shape-control elements comprise projections extending longitudinally along the axial direction of said outer wall, wherein said projections have a hemispherical cross-section.

5. A container for compaction processing of a powder as in claim 1, wherein said shape-control elements comprise projections that are formed integrally with the outer wall of said container.

6. A container for compaction processing of a powder as in claim 1, wherein said shape-control elements comprise at least one of plates, ribs, or a combination of both that are welded onto the outer wall of said container.

7. A container for compaction processing of a powder as in claim 1, wherein said shape-control elements comprise dimples located along the outer wall of said container.

8. A container for compaction processing of a powder as in claim 1, wherein said shape-control elements comprise dimples located along an inside surface of the outer wall of said container.

9. A container for compaction processing of a powder as in claim 1, wherein said shape-control elements comprise projections located along said outside wall of the container and extending longitudinally in a manner that is diagonal to the axial direction of said outer wall.

10. A container for use during hot isostatic pressing of a powder into a billet, the container defining axial and circumferential directions, the container comprising:

a container top;

a container bottom;

at least one wall contacting the powder, said wall being flat along the axial direction and extending between said container top and said container bottom; and a plurality of shape-control elements connected to said wall and extending longitudinally between said container top and said container bottom, said shape-control elements configured for controlling the deformation of the container during the hot isostatic processing such that the resulting billet has at least one surface in contact with said wall that is convex, concave, or both after the hot isostatic processing.

11. A container for use during hot isostatic pressing of a powder into a billet as in claim 10, wherein said at least one wall of the container is substantially flat prior to the hot isostatic pressing.

12. A container for use during hot isostatic pressing of a powder into a billet as in claim 10, wherein said at least one wall contacting the powder comprises a metal.

13. A container for compaction processing of a powder, the container comprising:

a cylindrically-shaped outer wall comprising a metal, said outer wall defining axial and circumferential directions, said outer wall extending in parallel to the axial direction;

a plurality of shape-control elements spaced along the circumferential direction of said outer wall and connected to said outer wall, said shape-control elements configured for allowing and determining the deformation of said outer wall as the volume of the powder is reduced under pressure to form a billet of a desired shape;

a container top connected to said outer wall; and a container bottom connected to said outer wall such that said outer wall extends between said container top and said container bottom so as to define an interior of the container for receipt of the powder.

* * * * *